US006439311B2

(12) United States Patent
Haseloh

(10) Patent No.: US 6,439,311 B2
(45) Date of Patent: Aug. 27, 2002

(54) METHOD OF RETARDING SAND BUILD UP IN HEAVY OIL WELLS

(75) Inventor: Peter Gerald Haseloh, Kindersley (CA)

(73) Assignee: Innovative Petroleum Technologies Corporation, Kindersley (CA)

( * ) Notice: Subject to any disclaimer, the term of this patent is extended or adjusted under 35 U.S.C. 154(b) by 2 days.

(21) Appl. No.: 09/784,388

(22) Filed: Feb. 15, 2001

(30) Foreign Application Priority Data

Apr. 18, 2000 (CA) ..... 2306012

(51) Int. Cl.[7] ..... E21B 43/12
(52) U.S. Cl. ..... 166/311; 166/369; 166/68.5
(58) Field of Search ..... 166/311, 312, 166/369, 370, 51, 54.1, 68, 68.5, 73, 78.1, 99, 105, 105.3, 105.4, 233

(56) References Cited

U.S. PATENT DOCUMENTS 3,941,423 A * 3/1976 Garte ..... 299/8
4,787,448 A * 11/1988 Sable ..... 166/176
4,995,456 A * 2/1991 Cornette et al. ..... 166/51
RE34,451 E * 11/1993 Donovan et al. ..... 166/55.1
5,277,254 A * 1/1994 Rullman et al. ..... 166/241.4
5,660,534 A * 8/1997 Snow ..... 417/554
6,182,754 B1 * 2/2001 Vermeeren ..... 166/176
6,290,475 B1 * 9/2001 Snow ..... 417/430

* cited by examiner

*Primary Examiner*—Frank Tsay
(74) *Attorney, Agent, or Firm*—Bennett Jones LLP

(57) ABSTRACT

A method of retarding sand build up in heavy oil wells involving a first step of providing a pumping apparatus with subterranean impellers coupled to a rotary top drive unit by a plurality of connective rods. The plurality of connective rods have fixed outwardly extending vanes that rotate with the plurality of connective rods and are configured to provide a supplementary lifting force. A second step involves positioning the plurality of connective rods in a heavy oil well having a circumferential sidewall. A third step involves activating the rotary drive unit to rotate the plurality of connective rods. The vanes attached to the connective rods assist in lifting sand to surface with the heavy oil.

4 Claims, 1 Drawing Sheet

METHOD OF RETARDING SAND BUILD UP IN HEAVY OIL WELLS

FIELD OF THE INVENTION

The present invention relates to a method of retarding sand build up in heavy oil wells.

BACKGROUND OF THE INVENTION

In some geographical areas, heavy oil can be extracted from underground formations using rotary pumping apparatus. One such geographical area is the region around Lloydminister, Alberta, Canada. It has been found, however, that the sand content in the wells around Lloydminster is causing frequent and costly servicing problems. The rotary pumping apparatus used is incapable of carrying the sand to surface. This is due, in part, to a restriction in flow which results from rod couplings positioned at intervals of approximately 7.5 meters extending up the well. As a result, sand settles toward the bottom of the wells. Approximately, once a month the wells become clogged with sand to the point that they will no longer produce oil. When this occurs a service rig must be sent out to clean out accumulated sand.

SUMMARY OF THE INVENTION

What is required is a method of retarding sand build up in heavy oil wells, as a substantial saving can be realized in reduced servicing costs and increased production if the time interval between servicing can be lengthened.

According to the present invention there is provided a method of retarding sand build up in heavy oil wells. A first step involves providing a pumping apparatus with subterranean impellers coupled to a rotary top drive unit by a plurality of connective rods. The plurality of connective rods have fixed outwardly extending vanes that rotate with the plurality of connective rods and are configured to provide a supplementary lifting force. A second step involves positioning the plurality of connective rods in a heavy oil well having a circumferential sidewall. A third step involves activating the rotary drive unit to rotate the plurality of connective rods. The vanes attached to the connective rods assist in lifting sand to surface with the heavy oil.

The method, as described above, greatly reduces the rate at which sand settles in the heavy oil well. The vanes can be configured in a number of different ways to provide a supplementary lifting force. Beneficial results have been obtained through the use of helical vanes. It is preferable that the vanes do not engage the circumferential sidewall of the well tubing as this would create unnecessary drag upon the rotation of the connective rods. It is, therefore, recommended that an annular clearance space be provided between an outer edge of the vanes and the circumferential sidewall of the well tubing.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
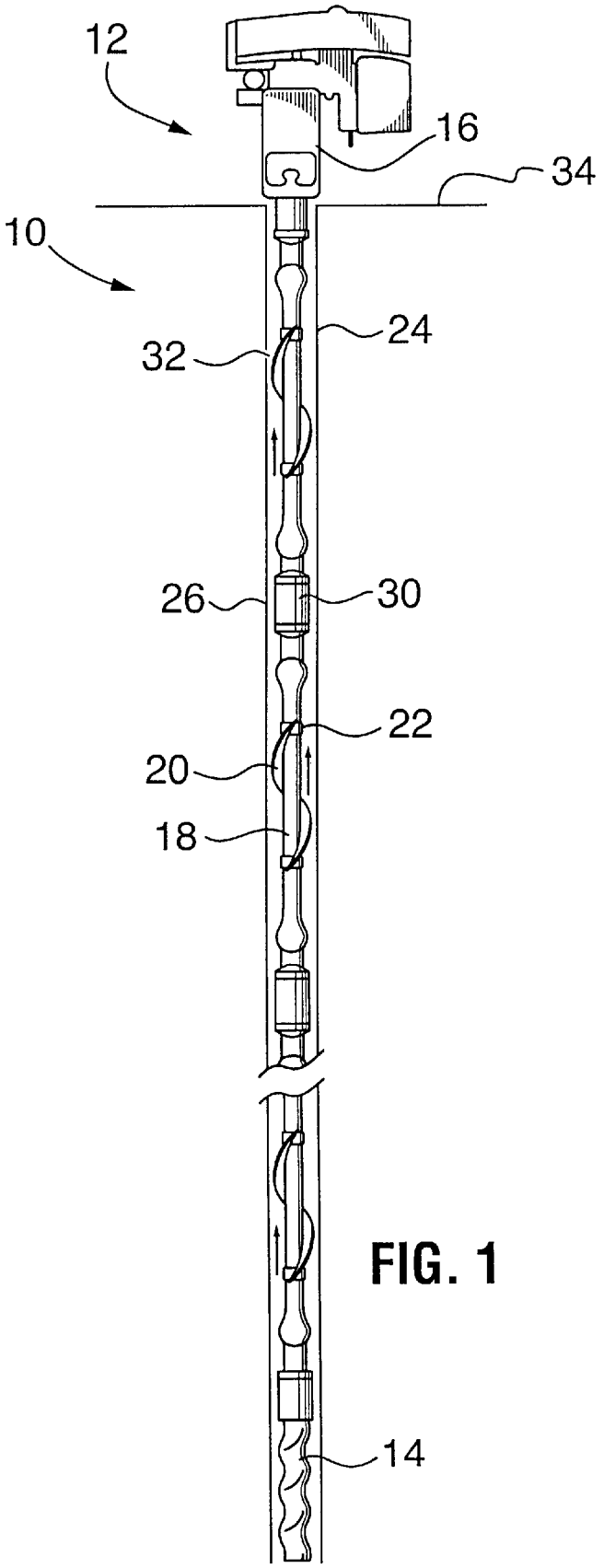
FIG. 1 is side elevation view of a heavy oil well with pumping apparatus configured in accordance with the teachings of the present invention.

The preferred embodiment, a method of retarding sand build up in heavy oil wells generally identified by reference numeral 10, will now be described with reference to FIGS. 1 and 2.

Figure 2:
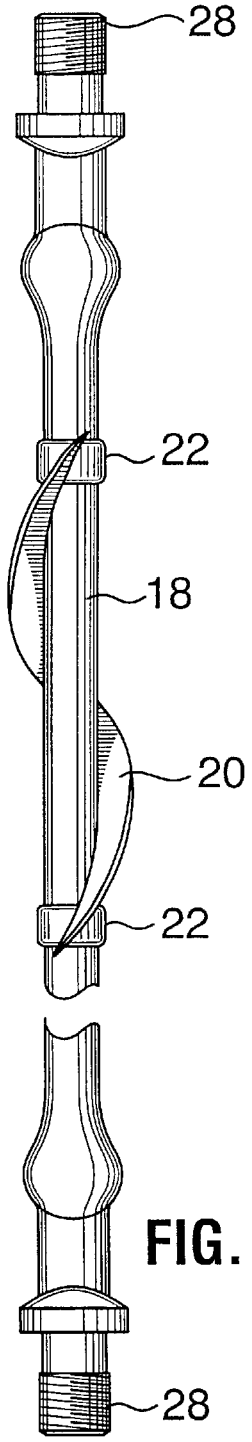
FIG. 2 is a detailed side elevation view of a connective rod used in the heavy oil well illustrated in FIG. 1.

Structure and Relationship of Parts:

Referring to FIGS. 1 and 2, there is provided a method of retarding sand build up in heavy oil wells, comprised of the following steps:

Referring to FIG. 1, a first step involves providing a pumping apparatus 12 with subterranean impellers 14 coupled to a rotary top drive unit 16 by a plurality of connective rods 18. Referring to FIG. 2, plurality of connective rods 18 have fixed outwardly extending helical vanes 20 that rotate with plurality of connective rods 18 and are configured to provide a supplementary lifting force. Vanes 20 are affixed to connective rods 18 by shrink couplings 22.

Referring to FIG. 1, a second step involves positioning plurality of connective rods 18 in a heavy oil well 24 which has a circumferential sidewall 26. Referring to FIG. 2, connective rods 18 have male threaded ends 28. Referring to FIG. 1, a female threaded coupling sleeve 30 fits over male threaded ends 28 in order to connect one of male threaded ends 28 of connective rod 18 to one of a male threaded end 28 of another connective rod 18. An annular clearance space 32 is provided between an outer edge of vanes 20 and circumferential sidewall 26 of well tubing 24.

Referring to FIG. 1, a third step involves activating rotary top drive unit 16 to rotate plurality of connective rods 18. Vanes 20 attached to connective rods 18 assist in lifting sand to surface 34 with the heavy oil.

Operation:

By following the teachings of this method, sand which would otherwise settle in the bottom of heavy oil well 24 and clog it, can be lifted along with the heavy oil to surface 34. A rotary drive unit 16 is connected to connective rods 18. Connective rods 18 are joined to each other and extend from rotary drive unit 16 to the bottom of well tubing 24. When rotary drive 16 is activated, connective rods 18 rotate. As connective rods 18 rotate, vanes 20 assist in moving the sand along with the heavy oil upwards through well tubing 24 to surface 34. Annular space 32 between vanes 20 and sidewall 26 of well tubing 24 prevents any unnecessary drag upon the rotation of connective rods 18. The removal of the sand along with the heavy oil reduces the necessity of frequent and costly servicing of heavy oil wells 24 due to clogging.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of retarding sand build up in heavy oil wells, comprising the steps of:

providing a pumping apparatus with subterranean impellers coupled to a rotary top drive unit by a plurality of connective rods, the plurality of connective rods having fixed outwardly extending vanes that rotate with the plurality of connective rods and are configured to provide a supplementary lifting force;

positioning the plurality of connective rods in a heavy oil well having a circumferential sidewall; and activating the rotary drive unit to rotate the plurality of connective rods, with the vanes attached to the connective rods assisting in lifting sand to surface with the heavy oil.

2. The method as defined in claim 1, the vanes on each of the plurality of connective rods being helical.

3. The method as defined in claim 1, an annular clearance space being provided between an outer edge of the vanes and the circumferential sidewall of the well tubing.

4. A method of retarding sand build up in heavy oil wells, comprising the steps of:

providing a pumping apparatus with subterranean impellers coupled to a rotary top drive unit by a plurality of connective rods, the plurality of connective rods having fixed outwardly extending helical vanes that rotate with the plurality of connective rods and are configured to provide a supplementary lifting force;

positioning the plurality of connective rods in a heavy oil well having a circumferential sidewall, with an annular clearance space being provided between an outer edge of the vanes and the circumferential sidewall of the well tubing; and activating the rotary drive unit to rotate the plurality of connective rods, with the vanes attached to the connective rods assisting in lifting sand to surface with the heavy oil.

* * * * *